US007344757B2

(12) United States Patent
Bischoff et al.

(10) Patent No.: US 7,344,757 B2
(45) Date of Patent: Mar. 18, 2008

(54) METHOD FOR TREATING OR PRETREATING CONTAINERS

(75) Inventors: Karl-Heinz Bischoff, Weinbach (DE); Mats Eriksson, Ytterby (SE); Norbert Kliehm, Altenstadt (DE); Lars Sebralla, Bruchkobel (DE); Markus Wahren, Hasselholm (DE); Manfred Walter, Lisengericht (DE)

(73) Assignee: Chemetall GmbH, Frankfurt am Main (DE)

( * ) Notice: Subject to any disclaimer, the term of this patent is extended or adjusted under 35 U.S.C. 154(b) by 588 days.

(21) Appl. No.: 10/297,138

(22) PCT Filed: May 21, 2001

(86) PCT No.: PCT/EP01/05778

§ 371 (c)(1),
(2), (4) Date: Aug. 8, 2003

(87) PCT Pub. No.: WO01/92445

PCT Pub. Date: Dec. 6, 2001

(65) Prior Publication Data

US 2004/0043907 A1 Mar. 4, 2004

(30) Foreign Application Priority Data

May 31, 2000 (DE) ..... 100 26 846
Sep. 27, 2000 (DE) ..... 100 49 005

(51) Int. Cl.

| | |
|---|---|
| ***B05D 1/00*** | (2006.01) |
| ***B05D 3/00*** | (2006.01) |
| ***B05D 3/02*** | (2006.01) |
| ***C10M 129/00*** | (2006.01) |
| ***C10M 133/00*** | (2006.01) |

(52) U.S. Cl. ..... 427/318; 427/327; 427/358; 427/388.4; 427/407.1; 427/419.1; 427/409; 427/421; 427/435; 427/250; 427/275; 427/247; 427/253; 427/430.1; 427/428; 508/110

(58) Field of Classification Search ..... 508/110; 427/318, 327

See application file for complete search history.

(56) References Cited

U.S. PATENT DOCUMENTS

| | | | | |
|---|---|---|---|---|
| 5,112,414 | A * | 5/1992 | Brands et al. | 148/254 |
| 5,413,972 | A | 5/1995 | Hwang et al. | |
| 5,622,569 | A * | 4/1997 | Dennis et al. | 134/2 |
| 6,436,475 | B1 * | 8/2002 | Adler et al. | 427/358 |
| 6,488,990 | B1 | 12/2002 | Wetterer et al. | |
| 2004/0062873 | A1 * | 4/2004 | Jung et al. | 427/407.1 |
| 2006/0093755 | A1 * | 5/2006 | Bittner et al. | 427/558 |

FOREIGN PATENT DOCUMENTS

WO WO 98/29580 A1 * 7/1998

* cited by examiner

*Primary Examiner*—Joseph D. Anthony
(74) *Attorney, Agent, or Firm*—Fulbright & Jaworski L.L.

(57) ABSTRACT

A process for the treatment or pretreatment of containers made of aluminum, aluminum-containing alloys, magnesium-containing alloys, iron-containing materials such as steel, coated iron-containing materials such as galvanized steel, or aluminum alloys, tinplate, brass or bronze, in particular the treatment or pretreatment of bags, tubs, bottles, cans, canisters, casks or tubes, wherein the process steps for the treatment or pretreatment take place at the same time as the application of the lubricant, with the agent used for the pretreatment or treatment, which also contains or is a lubricant, not essentially consisting of titanium or zirconium with fluoride and polymer, the lubricant possibly being formed first in the agent for the pretreatment or treatment or in the formation of the coating produced therefrom.

92 Claims, No Drawings

METHOD FOR TREATING OR PRETREATING CONTAINERS

BACKGROUND AND SUMMARY OF THE INVENTION

The present invention relates to a process for the treatment or pretreatment of containers made of aluminium, aluminium-containing alloys, magnesium-containing alloys, iron-containing materials such as steel, coated iron-containing materials such as galvanized steel, galvanized metallic materials or metallic materials coated with aluminium or aluminium alloys, tinplate, brass or bronze. These containers may be bags, tubs and similar packagings, bottles, cans, canisters, casks and tubes, such as for example screw-cap closures.

Normally containers are prepared for lacquering in continuous pretreatment units. Such containers, in particular cans, are produced on an industrial scale using foils, metal sheeting or moulded articles made of aluminium, aluminium alloys or tinplate, and after cleaning, pretreatment, lacquering and drying, are filled with beverages, foodstuffs or other products and are then closed and/or sealed. Cans are pretreated in most can pretreatment units at a rate ranging from 500 to 5000 cans per minute. For this reason stringent demands are placed on the speed of all procedures and on the reliable accomplishment of all process steps. Furthermore stringent demands are placed on the sliding properties of the containers in the continuous pretreatment unit, including printer and/or lacquering unit, as well as on the adhesion of lacquer and/or other subsequent coatings and on corrosion resistance.

EP-A-0 293 820, EP-A-0 413 328 and EP-A-0 542 378 describe processes for the coating of aluminium cans with a lubricant that essentially consists of ethoxylated compounds, in particular surfactants.

From WO 98/29580 a process is known for the coating with self-organising molecules for the pretreatment of metallic surfaces. The PCT applications relating to a cerium sulfamate coating process and to a bismuth-accelerated cerium coating process, which were filed round about 19.03.2001 by the Commonwealth Scientific and Industrial Research Organisation of Australia under the title "Process and solution for providing a conversion coating on a metallic surface I" and "Process and solution for providing a conversion coating on a metallic surface II", describe environmentally friendly, chromium-free coating processes for metallic surfaces. In addition WO 00/63303, WO 00/46312, WO 00/46311, WO 00/46310, WO 00/39356, WO 00/39177, WO 99/14399, WO 98/30735, WO 98/19798, WO 95/24517 and U.S. Pat. No. 6,162,547 describe the coating of metallic surfaces with silane-containing solutions and/or dispersions. These publications are understood to be expressly incorporated in the present application as regards the compositions, process parameters and process steps cited in the above publications. These publications do not disclose however the sliding properties of the coatings described therein and whether this process is also suitable for coating containers, in particular at very high rates and correspondingly short process times. In fact, the coating conditions applicable to individual parts or metal sheeting, in particular in the case of slow coating or in the laboratory, differ markedly from the conditions of the extremely quick conveyor belt operation.

OBJECTS AND SUMMARY OF THE INVENTION

The object of the invention is to overcome the disadvantages of the prior art and in particular to provide a simpler and more cost-effective process for the treatment or pretreatment of containers that offers, at the very high rates of mass production, a reliable pretreatment or treatment and a high corrosion resistance, a good lacquer adhesion as well as an outstanding sliding property of the coated and dried containers.

This object is achieved by the process for the treatment or pretreatment of containers made of aluminum, aluminum-containing alloys, magnesium-containing alloys, iron-containing materials such as steel, coated iron-containing materials such as galvanized steel, galvanized metallic materials or metallic materials coated with aluminum or aluminum alloys, tinplate, brass or bronze, in particular the treatment or pretreatment of bags, tubs, bottles, cans, canisters, casks or tubes, characterized in that the process steps for the treatment or pretreatment take place at the same time as the application of the lubricant, with the agent used for the pretreatment or treatment, which also contains and/or is a lubricant, not essentially consisting of titanium and/or zirconium with fluoride and polymer, the lubricant possibly being formed first in the agent for the pretreatment or treatment and/or in the formation of the coating produced therefrom.

Another embodiment relates to a press for the treatment or pretreatment of containers made of aluminum, aluminum-containing alloys, magnesium-containing alloys, steel or tinplate, in particular for the treatment or pretreatment of bags, tubs, bottles, cans, canisters or casks, characterized in that the agent applied for the treatment or pretreatment is at the same time also a lubricant, the lubricant possibly being formed first in the agent for the pretreatment or treatment and/or in the formation of the coating produced therefrom.

DETAILED DESCRIPTION

The agent for the treatment or pretreatment preferably exists as an aqueous solution and/or as a solution in an organic solvent. It may however also exist as a dispersion, particularly when using silane-containing treatment agents. The agent for the treatment or pretreatment contains a good lubricant—in the case of a mixture—and/or is according to the invention ideally suitable, not only as regards lacquer adhesion and corrosion resistance, but at the same time is a good lubricant, with the result that the external parts that are hereby (pre)treated, in particular sprayed, slide better on contact with similar containers and/or on the guide tracks of the unit.

In the process according to the invention the treatment or pretreatment with solutions according to the invention may also take place on already treated or pretreated container surfaces, particularly if the lacquer adhesion and/or the corrosion resistance of the preceding treatment or pretreatment is not yet sufficiently good and a combination of particularly high-grade properties is to be achieved.

Hereinafter, for the purposes of simplification, when speaking of the agent for the treatment or pretreatment, which at the same time contains or is a lubricant, only the term treatment agent will be used even if in many cases it additionally or solely serves to cover the pretreatment.

The action of the lubricant may be manifested only after application of the coating according to the invention. Accordingly the expression "lubricant that is contained in the treatment agent or, as a treatment agent, is also a lubricant", denotes an agent whose action may be determined only after the application of a coating and after this coating has dried. The coating may consist of at least one chemical compound that is possibly formed only on contact with a solvent and/or with the substances contained in the solution and/or dispersion, and/or on drying, heating and/or polymerisation, and that acts as a lubricant only in the coating.

The process according to the invention relates to the treatment or pretreatment of containers made of aluminium, aluminium-containing alloys, magnesium-containing alloys, iron-containing materials such as steel, coated iron-containing materials such as galvanized steel, galvanized metallic materials or metallic materials coated with aluminium or aluminium alloys, tinplate, brass or bronze, the process steps of the treatment or pretreatment coinciding with the application of the lubricant, with the agent used for the treatment or pretreatment, which also contains and/or is a lubricant, not consisting essentially of titanium and/or zirconium together with fluoride and polymer.

The process according to the invention serves in particular for the treatment or pretreatment of containers of aluminium, aluminium-containing alloys, magnesium-containing alloys, steel or tinplate, in particular bags, tubs, bottles, cans, canisters or casks, in which the agent applied for the treatment or pretreatment is at the same time also a lubricant. In particular, bags and tubs may be produced from metallic foils and/or laminates.

The preferred containers to be coated include bags, tubs, bottles, cans, canisters, casks and tubes; the tubes include in particular one-part or multipart tubes, cartridge cases, tablet tubes and closure-type tubes such as for example screw-cap closures and cigar tubes.

The metallic materials to be coated include in particular galvanized metallic substrates that may have been galvanized in various ways, and also other zinc-containing coatings such as for example Galfan®, Galvalume® and Galvanneal® as well as galvanized steel. In addition silicon-containing alloys may also be employed that may for example contain amounts of aluminium, magnesium and/or silicon and in which the contents of these elements may be comprised in various forms, such as for example as the element per se or as an intermetallic compound, and in which the contents of aluminium, magnesium and/or silicon are often only of the order of magnitude of about 0.3 to 3%.

In the process according to the invention involving the agent for the pretreatment or treatment (=treatment agent), preferably a conversion coating of the first and/or second type is formed on the metallic substrate. In the formation of the conversion coating of the first type, atoms are dissolved out from the metallic surface, and possibly react as ions with atoms and/or ions from the treatment agent and form a conversion coating on the surface. In the formation of the conversion coating of the second type, atoms and/or ions of the treatment agent form a chemical bond with atoms and/or ions of the surface of the substrate that remain in the surface, to produce a conversion layer. The latter type of conversion coating occurs in particular with compounds of the type XYZ, X*Y*Z* and/or X*Y*Z*Y*X* and in treatment agents containing silanes/siloxanes.

The treatment agent may be an aqueous solution or an aqueous dispersion. The term dispersion includes in this connection also emulsions and suspensions.

The treatment agent used for the process according to the invention is preferably free or largely free of fluoride or of a combination of fluoride and polymer. In many cases however, a small content of complex fluoride may be advantageous.

The agent may also be characterised by the fact that it contains not more than 10 wt. % of phosphate, preferably not more than 6 wt. % of phosphate, particularly preferably not more than 3 wt. % of phosphate. Most preferably, in particular, the agent is free or largely free of phosphate, the phosphate content being calculated in each case as $PO_4$.

The treatment agent is advantageously free or largely free of chromium. The term "largely free of chromium" refers to the fact that a chromium compound is not intentionally added in the treatment or pretreatment. It cannot be excluded however, that traces of chromium are dissolved out from the substrate, or that traces of chromium are contained in the compounds of the treatment agent that are employed and/or are entrained from one of the previous baths.

The treatment agent is preferably free or largely free of iron, manganese, nickel, cobalt, copper, other steel additives/improvers and/or zinc, and in particular is free or largely free of heavy metals of all types. In this connection it is advantageous if the agent is, in particular, free or largely free of nickel, cobalt, copper and/or other transition metals. The term "largely free of . . . " has the same meaning as given previously for the chromium content. In the case of a pickling effect that may possibly occur, the elements that are found in the pickled metallic surface, i.e. normally the elements of the metal and/or alloy of the metallic surface, are however usually also taken up by the bath.

The treatment agent may consist essentially of compounds based on compounds of the type X*Y*Z* and/or X*Y*Z*Y*X*, and/or, in particular, of phosphonate, compounds based on silicon and/or compounds based on at least one element selected from the rare earth elements including scandium, yttrium and lanthanum. Furthermore the agent may in each case contain, in particular, at least one biocide, a demulsifier, a fragrance, an emulsifier, a defoaming agent, a solubility promoter, a surfactant, an agent for adjusting the pH value, an agent for adjusting the electrical conductivity and/or at least one other auxiliary substance. The other auxiliary substances required for such solutions and/or dispersions are in principle known to the person skilled in the art.

The treatment agent according to the invention may be free or largely free of ethoxylated compounds, and may be preferably free or largely free of all types of surfactants.

In a first advantageous modification of the process according to the invention, the agent for the treatment or pretreatment, which is optionally a lubricant, may contain at least one compound of a rare earth element, in particular at least one compound selected from the group of chloride, nitrate, sulfate, sulfamate as well as complexes, for example with a halogen or with an aminocarboxylic acid, above all complexes with EDTA, NTA or HEDTA, in which connection scandium, yttrium and lanthanum are also regarded as rare earth elements within the meaning of the present application.

This treatment agent preferably contains a cerium compound as the at least one rare earth element compound, in particular in a mixture with other rare earth elements. The various rare earth elements may occur in a mixing ratio that is usual, for example, in a mixed metal.

The treatment agent may also contain at least one oxidising agent, in particular a peroxide, and/or at least one accelerator, preferably a compound of Bi, Cu and/or Zn.

The treatment agent is preferably an aqueous solution containing 1 to 300 g/l of at least one rare earth element inclusive of scandium, yttrium and lanthanum, 0.05 to 500 mg/l of at least one element selected from groups VA and VIA of the periodic system of the elements, in particular from the group of Bi, Sb, Se and Te, 0.02 to 250 mg/l of a complexing agent, in particular selected from the group of EDTA, HEDTA and NTA, 1 to 100 g/l of an oxidising agent, in particular based on peroxide and in this case calculated as $H_2O_2$, and at least one acid, in particular a mineral acid, preferably at least 30 mg/l of hydrochloric acid, in order to adjust the pH value in the range from 1 to 3.

On account of the pickling action of this treatment agent there may be a relatively high content of metal ions, such as for example aluminium ions, in the bath, which however does not normally interfere. Also, there is normally no slurry formation. The treatment time with this treatment agent may be in the range from 0.5 to 120 seconds, and in conveyor belt coating preferably in the range from 1 to 10 seconds. The temperature may, depending on the circumstances, vary in the range from 10° to 90° C. Good results may be achieved in the temperature range from 30° to 70° C. The layer weight after drying is preferably in the range from 0.05 to 1 g/m$^2$, particularly preferably in the range from 0.1 to 0.5 g/m$^2$.

A second variant of preferred treatment agents is based on a content of at least one silane and the compounds possibly formed therefrom in aqueous solution or dispersion, in particular as the main component in an amount of at least 40 wt. %, in each case calculated without reference to solvents, the content of silanes and the compounds possibly formed therefrom in aqueous solution or dispersion preferably being at least 60 wt. % of all dissolved or dispersed substances of the treatment agent, being particularly preferably at least 80 wt. %. Alternatively or in addition to other essential constituents that form a conversion layer of the first and/or second type, the treatment agent may contain at least one silane. A combination of at least one monofunctional silane with at least one bifunctional silane is preferably chosen. In many cases, when using silane-containing treatment agents, largely or wholly hydrolysed silanes are first of all formed to some extent until the treatment agent deposits a silane-containing/siloxane-containing coating. When the silanes in the aqueous solution or dispersion come into contact with water and other compounds/ions and during the drying, heating and/or crosslinking of this coating, the silanes are at least partially converted into siloxanes or oligomers, polymers and/or derivatives of the siloxanes as well as other derivatives of the silanes.

The agent for the treatment or pretreatment, which is also a lubricant or contains a lubricant and is an aqueous solution or dispersion, may contain at least one silane, with, it being possible, in addition, for there to be contained condensation products and/or reaction products formed from the silanes in the solution or dispersion, such as siloxanes or oligomers, polymers and/or derivatives of the siloxanes, as well as other derivatives of the silanes, in particular at least one compound selected from the group of monosilanes, bis-silanes and multisilanes, especially:

monosilanes of the general formula $SiX_mY_{4-m}$ where m=1 to 3, preferably m=2 to 3, where X=alkoxy, in particular methoxy, ethoxy and/or propoxy, and where Y is selected as a functional organic group from the group of alkyl, acrylate, amino, epoxy, glycidoxy, urea, isocyanate, mercapto, methacrylate and/or vinyl, bis-silanes of the general formula $Y_{3-p}X_p$—Si—Z—Si—X—$Y_{3-n}$ where p and n=1 to 3 and are identical or different, where X=alkoxy, in particular methoxy, ethoxy and/or propoxy, where Y is selected as functional organic groups from the group of alkyl, acrylate, amino, epoxy, glycidoxy, urea, isocyanate, mercapto, methacrylate, sulfur $S_q$ where q=1 to 20, and vinyl, where Z is selected from the group of $C_nH_2n$ where n=2 to 20, branched or unbranched as the case may be, singly unsaturated alkyl chains of the general formula $C_nH_{2n-2}$ where n=2 to 20, branched or unbranched as the case may be, doubly and/or multiply unsaturated alkyl compounds of the general formulae $C_nH_{2n-4}$ where n=4 to 20, branched or unbranched as the case may be, $C_nH_{2n-6}$ where n=6 to 20, branched or unbranched as the case may be, or $C_nH_{2n-8}$ where n=8 to 20, in each case branched or unbranched, and ketones, monoalkylamines, ethylene and NH, multisilanes of the general formula $Y_{3-p}X_p$—Si—Z'—Si—$X_nY_{3-n}$ where p and n=1 to 3 and are identical or different, where X=alkoxy, in particular methoxy, ethoxy and/or propoxy, where Y are functional organic groups selected from the group of alkyl, acrylate, amino, epoxy, glycidoxy, urea, isocyanate, mercapto, methacrylate, sulfur $S_q$ where q=1 to 20, and vinyl, and where Z'=N—Si—$X_rY_{3-r}$ where r=1 to 3, multisilanes of the general formula $Y_{3-p}X_p$—Si—Z"—Si—$X_nY_{3-n}$ where p and n=1 to 3 and are identical or different, where X=alkoxy, in particular methoxy, ethoxy and/or propoxy, where Y are functional organic groups selected from the group of alkyl, acrylate, amino, epoxy, glycidoxy, urea, isocyanate, mercapto, methacrylate, sulfur $S_q$ where q=1 to 20, and vinyl, and where Z"=—R—C[(Si $X_sY_{3-s}$)(Si $X_tY_{3-t}$)]-R'-where s and t=1 to 3 and are identical or different, where R and R' are identical or different and are selected from the group of $C_nH_{2n}$ where n=2 to 20, branched or unbranched as the case may be, singly unsaturated alkyl chains of the general formula $C_nH_{2n-2}$ where n=2 to 20, branched or unbranched as the case may be, doubly and/or multiply unsaturated alkyl compounds of the general formulae $C_nH_{2-4}$ where n=4 to 20, branched or unbranched as the case may be, $C_nH_{2n-6}$ where n=6 to 20, branched or unbranched as the case may be, or $C_nH_{2n-8}$ where n=8 to 20, branched or unbranched as the case may be, and ketones, monoalkylamines, ethylene and NH, in which connection the silanes may in each case be present in hydrolysed, partially hydrolysed and/or non-hydrolysed form in a solution, emulsion and/or suspension.

The treatment agent may contain at least one silane that is selected from the group of monosilanes where m=2 or 3, X=alkoxy, in particular with 1 to 8 C atoms, and Y=alkyl, amino, alkylamino, glycidoxy, urea and/or methacrylate.

The treatment agent may, instead or in addition to the silane, contain at least one silane selected from the group of bis-silanes, where n=3, X=alkoxy, in particular with 1 to 8 C atoms, and Z=alkyl, amino, alkylamino, glycidoxy, urea and/or methacrylate.

The treatment agent may contain at least one acid or at least one alkali and optionally an organic solvent. A mineral acid or a carboxylic acid, such as for example formic acid, acetic acid or propionic acid, is preferred as acid. As alkali there may be used inter alia an alkali hydroxide, ammonia, but also an amino compound having an alkaline action. The aqueous treatment agent may be free of organic solvents, either because no such solvents have been added and/or because the organic solvents, such as for example an alcohol, formed in the chemical reactions in the aqueous solution or dispersion have been removed. It is preferred to keep the content of organic solvents as low as possible, provided the solubility in water of the silanes employed and of the condensation products and reaction products formed therefrom is sufficient. Deionised water is preferably used as water.

Furthermore the treatment agent may also contain at least one complex fluoride of aluminium, boron, hafnium, silicum, titanium or zirconium, the content of the complex fluorides preferably being not more than 20 g/l, in particular nor more than 12 g/l, most particularly preferably not more than 8 g/l, and especially not more than 5 g/l.

The treatment agent preferably contains 0.5 to 200 g/l of at least one silane, including the compounds possibly formed therefrom and reacting in the aqueous solution or dispersion, particularly preferably 1 to 50 g/l. The treatment agent may have a pH value in the range from 2 to 12, the pH value commonly being selected in the range from 4 to 10 depending on whether the treatment is carried out under alkaline or acid conditions. The temperature during the conversion coating procedure with the treatment agent may be in the range from 10° up to 95° C., in particular in the range from 15° to 50° C., preferably room temperature or slightly above. This means that often the heating of the treatment agent for the coating or the heating of the container to be coated can be omitted. The coating procedure with the treatment agent according to the invention may take 0.1 second up to many minutes, in particular 0.2 second up to 12 minutes, coating times on the conveyor belt in the range from 0.1 to 10 seconds being preferred. The coating time is normally not a critical parameter for the formation of the conversion layer since the layer thickness that is formed is substantially independent of the treatment time. This makes possible an extremely simple and inexpensive coating, with the result that the comparatively expensive silanes are used only sparingly. This means moreover that conveyor belt stoppages have practically no effect on the coating quality, for example of the cans, and accordingly there is practically no possibility of producing defective products. After the coating with the silane-containing treatment agent, the coated substrate should not normally be rinsed since there is the danger that the conversion layer can be at least partially removed. The drying of the (pre)treated containers may be carried out in the range from room temperature up to 180° C., preferably in the range from 60° up to 100° C., depending on the desired drying time, equipment and/or selected energy expenditure. The hardening as well as the possibly further reaction to form siloxanes or corresponding oligomers, polymers and derivatives or also to form other derivatives of the silanes, takes place on drying. After the drying the layer is adherent and water-insensitive. The layer thickness formed after the drying is normally in the range from 5 to 2000 nm, in particular in the range from 20 to 1000 nm, so that often the layer weight is in the range from 3 to 550 mg/m$^2$, particularly commonly in the range from 20 to 150 mg/m$^2$.

In a third particularly advantageous variant of the process according to the invention, the agent for the treatment or pretreatment, which is optionally a lubricant, contains at least one compound of the type XYZ, X*Y*Z* and/or X*Y*Z*Y*X*, wherein Y is an organic group with 2 to 50 C atoms, X and Z are identical or different and denote an —OH, —SH, $NH_2$, —NHR', —CN, —CH═$CH_2$, —OCN, —CONHOH, —COOR', acrylic acid amide, epoxy, $CH_2$═CR"—COO—, —COOH, $HSO_3$—, $HSO_4$—, $(OH)_2PO$—, $(OH)_2PO_2$—, (OH)(OR')PO—, (OH)(OR')$PO_2$—, —$SiH_3$ and/or an —$Si(OH)_3$ group, wherein R' is an alkyl group with 1 to 4 C atoms, R" is an H atom or an alkyl group with 1 to 4 C atoms and the groups X and Z are in each case bound to the group Y at its terminal position, Y* is an organic group with 1 to 30 C atoms, X* and Z* are identical or different and denote an —OH, —SH, —$NH_2$, —NHR', —CN, —CH═$CH_2$, —OCN, —CONHOH, —COOR', acrylic acid amide, epoxy, $CH_2$═CR"—COO—, COOH, $HSO_3$—, $HSO_4$—, $(OH)_2PO$—, $(OH)_2PO_2$—, (OH)(OR')PO—, (OH)(OR')$PO_2$—, $SiH_3$—, —$Si(OH)_3$, >N—$CH_2$—$PO(OH)_2$ and/or an —N—[$CH_2$—$PO(OH)_2]_2$ group, wherein R' is an alkyl group with 1 to 4 C atoms, and R" is an H atom or an alkyl group with 1 to 4 C atoms.

In this connection the agent for the treatment or pretreatment, which is optionally a lubricant, may contain at least one compound of the type XYZ, wherein X is a —COOH, —$HSO_3$, —$HSO_4$, $(OH)_2PO$—, $(OH)_2PO_2$—, (OH)(OR')PO or (OH)(OR')$PO_2$— group, Y is an organic group R that contains 2 to 50 C atoms, of which at least 60% of these C atoms are present as $CH_2$ groups, Z is an —OH, —SH, —$NH_2$, —NHR', —CN, —CH═$CH_2$, —OCN, epoxy, —CH═CR"—COOH, acrylic acid amide, —COOH, $(OH)_2PO$—, $(OH)_2PO_2$—, (OH)(OR')PO— or (OH)(OR')$PO_2$— group, wherein R' is an alkyl group with 1 to 4 C atoms and R" is an H atom or an alkyl group with 1 to 4 C atoms.

Preferably in this connection the groups X* and Z* of the compound of the type X*Y*Z* and/or X*Y*Z*Y*X* are in each case bonded to the group Y* in its terminal position.

In this connection the compound of the type XYZ, X*Y*Z* and/or X*Y*Z*Y*X* may be suitable for forming self-organising molecules (SAMs) that can form a layer of these self-organising molecules on the metallic surface, especially a monomolecular layer. In particular in this connection Y or Y* may be a linear unbranched group. On account of the often rapid coating stage, the coating may be incomplete—surprisingly almost without having any detectable effect on the properties of the coating. The coating may be present in part in a regular arrangement and in part in a random arrangement, the regularly arranged parts often being present in monomolecular form. Despite this very thin covering this coating has outstanding properties, in particular outstanding sliding properties, lacquer adhesion and corrosion resistance. The coating should therefore be employed extremely sparingly and is in addition environmentally friendly.

Preferably Y or Y* is a linear, unbranched or branched chain, optionally with at least one functional group, in particular a chain with at least one alkyl group and/or an aromatic group.

In the process according to the invention the more effective compounds of the type XYZ, X*Y*Z* and/or X*Y*Z*Y*X* often contain a group Y or Y* that has an even number of C atoms. At least one compound of the type XYZ, X*Y*Z* and/or X*Y*Z*Y*X* may in this connection be present as salt and/or as acid in an aqueous solution.

Preferably at least one compound of the type XYZ, X*Y*Z* and/or X*Y*Z*Y*X* is present as salt in the solution. The group Y or Y* of the more effective compounds of the type XYZ, X*Y*Z* and/or X*Y*Z*Y*X* may be an unbranched straight-chain alkyl group with 3 to 30 C atoms.

The agent for the treatment or pretreatment may also contain at least one compound of the type XYZ, X*Y*Z* and/or X*Y*Z*Y*X*, in which Y or Y* is an unbranched alkyl group with 2 to 20 C atoms or an unbranched group consisting of 1 to 4 aromatic $C_6H_4$ nuclei bonded in the p-position, or is a group consisting of 1 or 2 unbranched alkyl radicals with in each case 1 to 20 C atoms, as well as 1 to 4 aromatic $C_6H_4$ nuclei bonded in the p-position.

The treatment agent may also contain at least one compound of the type XYZ, X*Y*Z* and/or X*Y*Z*Y*X* in which Y or Y* is an unbranched alkyl group with 6 to 20 or preferably 10 to 18 C atoms or is a p-$CH_2$—$C_4H_6$—$CH_2$ group or a p,p'-$C_6H_4$—$C_6H_4$ group.

The agent may also contain at least one compound of the type XYZ, X*Y*Z* and/or X*Y*Z*Y*X* in which X or X* is an $(OH)_2PO_2$— or (OH)(OR')$PO_2$— group.

Furthermore, it may contain at least one compound of the type XYZ, X*Y*Z* and/or X*Y*Z*Y*X* in which Z or Z* is an $(OH)_2PO_2$— or —(OH)(OR')$PO_2$—, —OH, —SH, —NHR', —CH═$CH_2$ or —CH═CR"—COOH group.

In the process according to the invention the agent for the treatment or pretreatment contains at least one of the following compounds of the type XYZ, X*Y*Z* and/or X*Y*Z*Y*X* and/or at least one of the corresponding derivatives, in particular salts:

1-phosphonic acid-12-mercaptododecane,
1-phosphonic acid-1,2-(N-ethylamino)dodecane,
1-phosphonic acid-12-dodecene,
p-xylylene-diphosphonic acid,
1,10-decanediphosphonic acid,
1,12-dodecanediphosphonic acid,
1,14-tetradecanediphosphonic acid,
1-phosphoric acid-12-hydroxydodecane,
1-phosphoric acid-12-(N-ethylamino)dodecane,
1-phosphoric acid-12-dodecene,
1-phosphoric acid-12-mercaptododecane,
1,10-decanediphosphoric acid,
1,12-dodecanediphosphoric acid,
1,14-tetradecanediphosphoric acid,
p,p'-biphenyldiphosphoric acid,
1-phosphoric acid-12-acryloyldodecane,
1,8-octanediphosphonic acid,
1,6-hexanediphosphonic acid,
1,4-butanediphosphonic acid,
1,8-octanediphosphoric acid,
1,6-hexanediphosphoric acid,
1,4-butanediphosphoric acid,
aminotrimethylenephosphonic acid,
ethylenediaminetetramethylenephosphonic acid,
hexamethylenediaminetetramethylenephosphonic acid,
diethylenetriaminepentamethylenephosphonic acid,
2-phosphonebutane-1,2,4-tricarboxylic acid.

Advantageously the agent for the treatment or pretreatment is present together with at least one compound of the type XYZ, X*Y*Z* and/or X*Y*Z*Y*X* in an aqueous solution, with in particular 0.01 to 50% of the water being able to be replaced by at least one organic solvent such as for example an alcohol with 1 to 8 C atoms, or by acetone, dioxane and/or by tetrahydrofuran. Preferably 0.1 to 50% of the water, particularly preferably 0.5 to 30% of the water, is replaced by an organic solvent which, in particular, is at least an alcohol with 1 to 4 C atoms.

The agent for the treatment or pretreatment may contain at least one compound of the type XYZ, X*Y*Z* and/or X*Y*Z*Y*X* that is present in an amount in the region of the critical micelle concentration or below, in particular in a concentration of 0.05 to 10 g/l. Preferably the concentration is 0.1 to 3 g/l, particularly preferably 50 to 1000 mg/l and most particularly preferably 100 to 600 mg/l.

Also it may be advantageous if, contained in addition to the compounds of the type XYZ, X*Y*Z* and/or X*Y*Z*Y*X*, are also minor amounts of further organic compounds, for example esters, in particular based on phosphonic acid, that may obviously have a positive influence on the solubility of the compounds of the type XYZ, X*Y*Z* and/or X*Y*Z*Y*X* in water.

The further organic compounds may be contained in water in particular in an amount of 0.01 to 15 g/l or may be contained in a water-solvent mixture, preferably in an amount of 0.02 to 2 g/l, in particular 0.05 to 0.3 g/l.

When using at least one compound of the type XYZ, X*Y*Z* and/or X*Y*Z*Y*X* in an aqueous solution, the contact time with the metallic surface may be in the range from 0.5 second to 10 minutes. The contacting is often carried out at a pH value in the range from 1 to 10, preferably in the range from 2 to 4; when coating containers, in particular cans, a mineral acid such as for example sulfuric acid is preferably added so that the pH value of this aqueous solution then preferably lies in the range from 0.5 to 3. It is recommended to use fully deionised water, which preferably has an electrical conductivity of ≦120 μS/cm, particularly preferably ≦20 μS/cm.

The coating of the surface with at least one of the compounds of the type XYZ, X*Y*Z* and/or X*Y*Z*Y*X* may be incomplete. The molecules of this/these compound(s) or compounds do not have to be aligned perpendicularly to the surface and parallel to one another as is otherwise the case in self-organising molecules, though this does ensure an unexpectedly high effectiveness of the coating. The longer the surface is coated with the agent according to the invention, the greater normally is the proportion of the surface coated with this/these compound(s) and the more often are their molecules aligned perpendicular to the surface and parallel to one another.

The agent for the treatment or pretreatment may, as regards the compounds that produce a conversion layer and serve as lubricant, consist only or essentially compounds of the type XYZ, X*Y*Z* and/or X*Y*Z*Y*X*.

In the process according to the invention, a treatment agent having at least one compound of the type XYZ, X*Y*Z* and/or X*Y*Z*Y*X* may also be used in order to improve the corrosion resistance and/or the lacquer adhesion.

The pH value of the aqueous solution that contains at least one compound of the type XYZ, X*Y*Z* and/or X*Y*Z*Y*X* may be in the range from 1 to 12, depending on whether the acids and/or their salts are used, in which connection the optimum working range may also vary depending on the selected compound. In many cases the pH value may be in the range from 1.5 to 6, preferably in the range from 2 to 4. Aluminium and aluminium alloys have proved to be particularly suitable metallic substrates for these treatment agents.

The multifarious treatment agents, i.e. not only those containing at least one compound of the type XYZ, X*Y*Z* and/or X*Y*Z*Y*X*, may preferably also contain at least one defoaming agent and/or a solubility promoter, in particular in an amount of, in each case, 0.0005 to 5 wt. %, preferably in an amount of, in each case, optionally 0.005 to 4 wt. %, especially in an amount of, in each case, optionally 0.1 to 3 wt. %.

The treatment agent may, in addition to water or a water-solvent mixture, consist of at least one compound of the type XYZ, X*Y*Z* and/or X*Y*Z*Y*X* or at least one silane as well as optionally a biocide, demulsifier, fragrance, emulsifier, defoaming agent, solubility promoter, surfactant, agent for adjusting the pH value, agent for adjusting the electrical conductivity and/or other auxiliary substances and optionally an amount of an organic solvent.

The respective treatment agent may be applied internally and/or externally to the containers by dipping or rolling, preferably however by sprinkling, spraying or atomization, optionally only over a part of the outer and/or inner surface, in particular over a time per container in the range from 0.5 to 120 seconds, preferably in the range from 1 to 80 seconds, particularly preferably in the range from 1.5 to 40 seconds, most particularly preferably in the range from 2 to 20 seconds. Especially in the case of large containers, the coating process may however last longer than 2 minutes, because for example the times involved in the immersion and removal from the bath as well as the draining of the liquid are also considerably longer. The coating times also depend in particular on the selected plant technology.

Advantageously at least one rinsing, in particular with deionised water, is carried out after the application of the treatment agent.

The treatment agent may be applied to a cleaned, rinsed and/or pickled surface or to a pre-annealed surface.

Before the application of the agent, for the treatment or pretreatment, the surface of the container may be cleaned to a neutral, acid or alkaline pH, optionally rinsed, optionally pickled to an alkaline or acid pH, and optionally rerinsed, in which connection water and/or organic solvent may be used as solvent. In addition a thin activation layer, for example based on titanium phosphate, may be applied before the conversion coating.

Before the application of the treatment agent, a different type of agent for the treatment or pretreatment in particular an agent that contains ions selected from the group comprising Ti, Zr, Hf, Cu, Fe, Mn, Ni, Zn, $PO_4$ and F, may be applied in a separate treatment stage. The ions are preferably contained in aqueous solution.

After the application of the agent for the treatment or pretreatment, which at the same time also improves the sliding properties, the (pre)treated containers are preferably rinsed, are optionally post-rinsed with a post-rinsing solution, optionally rerinsed and dried, in which connection water and/or an organic solvent may be used as solvent.

The process according to the invention may also be modified so that, after the application of the treatment agent, which at the same time also serves as a lubricant, rinsing is no longer performed. This may apply in particular to beverage cans treated with compounds of the type XYZ, X*Y*Z* and/or X*Y*Z*Y*X*, in particular to compounds with self-organising molecules.

Process according to at least one of the preceding claims, characterised in that the treatment agent is applied in a conveyor belt unit, in particular in pretreatment and lacquering units for containers such as for example cans or bags.

The treatment agent according to the invention may be applied on the conveyor belt over a time in the range from 0.1 to 120 seconds, preferably over a time in the range from 0.5 to 20 seconds, while in the case of a slower application it is preferably applied over a time in the range from 1 to 120 seconds, in particular over a time in the range from 5 to 60 seconds. In many cases however an application time of for example more than 10 minutes is not a disadvantage.

In the process according to the invention the treatment agent may be applied to metallic surfaces of containers that are at a temperature in the range from 10 to 120° C. The treatment agent may be at a temperature in the range from 10 to 95° C. when applied to the containers.

The layer of the treatment agent may have, after drying, a thickness in the range from 0.01 to 3 μm, preferably in the range from 0.1 to 1 μm, and/or may consist of one or a few molecular layers, in particular of 1 to 20 molecular layers in the case of compounds of the type XYZ, X*Y*Z* and/or X*Y*Z*Y*X*, in which case a coating may be present in particular in the range from 0.1 to 30 nm.

The treated and/or pretreated containers are preferably dried under mass production conditions at an oven temperature of at least 180° C., in particular at temperatures ≧200° C., particularly preferably at temperatures ≧220° C. and most particularly preferably at temperatures ≧250° C. Higher temperatures may occur in the drying zone especially if there is a conveyor belt stoppage during the pretreatment and lacquering of for example cans. In this connection, the conveyor belt stoppage may in many cases last for example for half an hour or even longer. Such temperatures are advantageous especially at very high conveyor belt speeds.

On the other hand the treated and/or pretreated containers may be dried at a temperature of at most 150° C. under mass production conditions, which is of great advantage as regards energy saving. Preferably the drying temperature is in the range ≦120° C., particularly preferably at temperatures ≦100° C., most particularly preferably at temperatures ≦80° C., above all at temperatures ≦50° C. and especially in the range from room temperature to 90° C. In this connection the excess pretreatment liquid may be blown off, in particular in the form of droplets, from the treatment surfaces, the drying temperature depending above all on the respective unit and the selected treatment speed. The changeover from hydrophilic to hydrophobic properties of the coated surfaces, from which the excess liquid can particularly easily be blown off and whereby very low drying temperatures can be adjusted, is utilised in particular in this connection: on account of the considerably reduced drying expenditure this process may be operated in a substantially more cost-effective manner.

The process according to the invention may furthermore be advantageously varied in that different types of containers for different intended uses, in particular different types of cans, can be pretreated or treated in the same unit using similar settings and/or in similar baths. The various types of baths may for example have the same composition but different concentrations. In this connection, different container shapes, in particular different container sizes, which are for example suitable for different contents such as for example beer, mineral water, juice or rice pudding, may be treated since different fillings are often added to differently shaped containers.

After drying the treatment agent, at least one lacquer, in particular an electrodeposition lacquer, powder lacquer, coil coating lacquer, wet lacquer, low-solvent high-solids lacquer and/or a lacquer diluted with water, at least another type of organic coating such as for example a primer containing inorganic constituents, at least an adhesive layer, at least a foil, at least a paper layer and/or at least a printing ink, may be applied.

It has now surprisingly been found that, due to the coating with compounds according to the invention, in particular of the type XYZ, X*Y*Z* and/or X*Y*Z*Y*X*, in addition to outstanding sliding properties there may also be achieved particularly hydrophobic surface properties that simplify the removal of liquid residues of the treatment agent from the produced film of the treatment layer.

For a good sliding behaviour of the (pre)treated containers on one another and on the transportation means it is necessary to achieve a minimum sliding value, optionally under the respective coating and drying conditions. As a measure of the sliding quality, a sliding test for cans is used in which three pyramidally shaped cans lie on top of one another and the base surface on which the lower two cans are resting can be tilted by an angular displacement. The angle of the inclined plane at which the uppermost can resting in the same direction on the two lower cans starts to slide onto the said lower cans is measured. A sufficient sliding value is considered to be an angle which, on comparing the cans cleaned in acid, rinsed in deionised water, (pre)treated and completely dried in a circulating air oven to cans of otherwise identical type but only cleaned in acid, rinsed in deionised water and dried completely in a circulating air oven, is at least 5° less than the sliding angle for the latter cans. This condition enables cans of widely varying shape and size to be subjected to this test. In the case of aluminium alloy cans 11.5 cm long and 6.5 cm in diameter and weighing 10.4 g, the cans that have been cleaned but have not yet been treated with the treatment agent have sliding angles in the range from 34° to 38°, in particular of about 35.5°, whereas the cleaned cans (pre)treated according to the invention are characterised by a sliding angle in the range from about 17° to 26° and thus have a sliding angle that is roughly 9.5° to 18.5° less than that of the cans that have only been cleaned. The smaller the sliding angles, the better the sliding ability and the better the results.

It has also surprisingly been found that, in particular in the case of coatings with compounds of the type XYZ, X*Y*Z* and/or X*Y*Z*Y*X*, at different coating speeds and/or interruptions in the conveyor belt (pre)treatment due to a malfunction of the process including a conveyor belt stoppage, which may last for a few seconds up to for example 60 minutes, an almost identical layer thickness and an almost identical quality of the treatment layer film is achieved. The containers that stay longer in the treatment/pretreatment zone due to the conveyor belt stoppage are accordingly not coated excessively with the treatment agent and are therefore not provided with expensive, unnecessarily thick coatings. Also, less treatment agent is thereby lost in the process than previously in conventional processes.

On the other hand, particularly coatings with compounds of the type XYZ, X*Y*Z* and/or X*Y*Z*Y*X* are especially advantageous since the films produced therewith can be dried at widely varying temperatures in the range from room temperature to more than 200° C. over very short or long times, without causing any significant change in the coating quality. Conveyor belt stoppages therefore do not have a negative effect on the containers in the drying unit.

Accordingly, the treatment or pretreatment of the containers in a conveyor belt unit may be designed far more robustly than hitherto and with a significantly lower failure rate of defectively coated containers. A conveyor belt stoppage in a can coating unit that is operating for example with 5000 cans per minute accordingly does not lead, in the case of an only 3-minute conveyor belt stoppage over the whole length of the conveyor belt unit, to a failure rate of for example 1000 to 20000 cans.

Tests on cans that have been coated under widely differing conditions in the laboratory and in a conveyor belt unit did not reveal any problems in the boiling test, in which a discoloration, in particular a brown discoloration, of the lid (bulging of the floor of for example a can) is tested by "boiling" for example for 20 minutes in water at 75° C., or in the retort test, in which the can is sterilised in an autoclave at for example 120° C. Also, no problems were found as regards printing or lacquering.

In this connection it is also possible to formulate slightly different coatings such as are required for example for widely differing container shapes, container sizes, container volumes and contents, such as for example alcoholic beverages, caffeine-containing beverages, soft drinks, milk products, mineral water, preserved fish, vegetables, fruit or soups, by varying different parameters such as concentration, temperature and/or the proportion of a compound in a treatment agent mixture.

Furthermore the treatment agents according to the invention are particularly environmentally friendly because the formation of a slurry can be wholly or largely avoided, because the solution or dispersion can be used either alone with water or with a low-solvent water-solvent mixture, because they may be free of heavy metals, because they are possibly even free or largely free of metals, and because the compounds of the treatment agents per se are normally particularly environmentally friendly. Compounds of the type XYZ, X*Y*Z* and/or X*Y*Z*Y*X* that are discharged in the waste water may readily be chemically bound and/or degraded.

EXAMPLES OF PREFERRED EMBODIMENTS

Individual embodiments are illustrated hereinafter by way of example.

Example 1

Treatment Agent Containing a Rare Earth Element

Aluminium sheets formed from the alloy AlMgl were degreased with alkali, rinsed with tap water, pickled under acid conditions, rinsed with tap water and then with deionised water. A bath containing an aqueous solution as treatment agent with a content of the following additives was then used in a dipping process:

ca. 10 g/l of at least one rare earth element, with there being a cerium content of more than 90%, ca. 60 mg/l of at least one element selected from the groups VA and VIA of the periodic system of the elements, with there being a bismuth content of more than 90%, ca. 50 mg/l of a complexing agent selected from the group of EDTA, HEDTA and NTA, ca. 10 g/l of an oxidising agent based on peroxide and calculated as $H_2O_2$, and at least one acid in an amount of at least 200 mg/l of hydrochloric acid, to adjust the pH value in the range from 1 to 3.

The coating was carried out at 40 to 50° C. Layer weights in the range from 15 to 30 mg/m$^2$ were obtained.

The sheets were thoroughly rinsed with tap water, dried and then coated with a lacquer. Aluminium cans were coated in a similar way. The results are shown in Table 1.

Table 1: Results of the sliding test and other specific can tests on cans (pre)treated with rare earth element, as well as the corrosion and lacquer adhesion tests on (pre)treated and lacquered sheets—Example 1:

| | Sliding Test on Similarly Coated Cans: Sliding Angle | Boiling Test on Cans | Retort Test on Cans |
|---|---|---|---|
| Pretreated, Unlacquered | a) about 9.5°-13.5° less than cans that were only cleaned<br>b) For standard can* about 22°-26° | No tarnishing within 1 hour | No tarnishing |
| | CASS salt spray mist test according to DIN 50021 over 240 hours | ESS test over 1008 hours | Cross-cut test after 240 hours KK |
| Additional polyester coil coating lacquer | Scratch and edge: 0 mm creepage | <1 mm creepage | Gt 0 |

In addition filiform tests were carried out in order to determine the creepage of the lacquer on a scratch after 1008 hours. In this connection creepage values of in each case less than 1 mm were found.

The results on chromium-free cerium-pretreated sheets coated with polyester powder lacquer corresponded as regards corrosion resistance and lacquer adhesion results to the results obtained on high-grade chromated sheets of this aluminium alloy.

Examples 2 and 3

Treatment Agent Containing Silane

Sheets of the aluminium alloy AlMgl were degreased in an alkaline medium, rinsed with tap water and then with deionised water. A bath containing an aqueous solution/dispersion as treatment agent with a content of the following additives was then used in the dipping process:

Example 2 ca. 10 g/l of at least one alkoxy-amino based monosilane, ca. 2 g/l of a complex fluoride based on titanium and optionally a minor amount of at least one acid or alkali for adjusting the pH value in the range 4 to 6.

Example 3 ca. 15 g/l of at least one alkoxy-amino based monosilane, ca. 15 g/l of at least one trifunctional bis-silane with amino groups, ca. 4 g/l of an alcohol in order to improve the solubility of the silanes, and a minor amount of a carboxylic acid in order to adjust the pH value in the range 4 to 5.

The coating with the treatment agent was carried out at about 25° C. over about 10 seconds. Layer weights in the range from 30 to 80 mg/m$^2$ were obtained.

The (pre)treated sheets were dried without rinsing at 80° C. PMT (Peak Metal Temperature) over 10 minutes and were then optionally coated with a lacquer. Aluminium cans were coated in a similar way. The results are shown in Table 2.

Table 2: Results of the sliding test and other specific can tests on silane (pre)treated cans as well as of the corrosion and lacquer adhesion tests on (pre)treated and lacquered sheets—Examples 2 and 3:

| | Sliding Test on Similarly Coated Cans: Sliding Angle | Boiling Test on Cans | Retort Test on Cans |
|---|---|---|---|
| Pretreated, Unlacquered | a) 13.5°-16.5° less than cans that were only cleaned<br>b) For standard can* 19°-22° | No tarnishing within 1 hour | No tarnishing |
| | CASS salt spray mist test according to DIN 50021 over 240 hours | ESS test over 1008 hours | Cross-cut test after 240 hours KK |
| Additional polyester coil coating lacquer | Scratch and edge: <1 mm creepage | <1 mm creepage | Gt 0 |

In addition filiform tests were carried out in order to determine the creepage of the lacquer on a scratch after 1008 hours. In this connection creepage values of in each case less than 1 mm were found.

The results on chromium-free silane-pretreated sheets coated with polyester lacquer corresponded as regards the corrosion resistance and lacquer adhesion results to the results obtained on high-grade chromated sheets of this aluminium alloy.

Examples 4 to 6

Treatment Agents Containing Self-Organising Organic Molecules Based on Phosphonate Metal sheeting of the aluminium alloy AlMgl was degreased in an alkaline medium, rinsed with tap water, pickled in an acid, rinsed again with tap water and then with deionised water. A bath containing an aqueous solution/dispersion as treatment agent with a content of the following additives was then used in a dipping process:

Example 4 ca. 0.22 g/l of diphosphonic acids and/or salts formed therefrom with a chain Y of about 8 to 14 C atoms, ca. 0.15 g/l of further organic compounds to improve the solubility of the phosphonic compounds, including inter alia esters, in deionised water, the desired pH value being adjusted automatically.

Example 5 ca. 0.12 g/l of diphosphonic acids and/or salts formed therefrom with a chain Y of about 8 to 14 C atoms, ca. 0.1 g/l of further organic compounds to improve the solubility of the phosphonic compounds, including inter alia esters, in deionised water, and at least 50 mg/L of sulfuric acid to adjust the pH to a value around 2.5.

Example 6 ca. 0.07 g/l of diphosphonic acids and/or salts formed therefrom with a chain Y of about 8 to 14 C atoms, ca. 0.05 g/l of further organic compounds to improve the solubility of the phosphonic compounds, including inter alia esters, in deionised water, the desired pH value being adjusted automatically.

The coating with the treatment agent was carried out at about 50° C. over 10 seconds at a pH value of about 3. Layer weights in the range from 1 to 10 mg/$m^2$ were achieved.

The (pre)treated metal sheeting was dried, without rinsing, at 80° C. for 10 minutes and was then optionally coated with a lacquer. Aluminium cans were coated in a similar way. The results are shown in Table 3.

Table 3: Results of the sliding test and other specific can tests on phosphonate (pre)treated metal sheeting as well as corrosion and lacquer adhesion tests on (pre)treated and lacquered metal sheeting—Examples 4 to 6:

| | Sliding Test on Similarly Coated Cans: Sliding Angle | Boiling Test on Cans | Retort Test on Cans |
|---|---|---|---|
| Pretreated, Unlacquered | a) 14.5°-18.5° less than cans that were only cleaned<br>b) For standard can* 17°-21° | No tarnishing within 2 hours | No tarnishing |
| | CASS salt spray mist test according to DIN 50021 over 1008 hours | ESS test over 4032 hours | Cross-cut test after 240 hours KK |
| Additional polyester powder lacquer | Scratch 1 mm | Scratch <1 mm | Gt 0 |
| Additional polyester coil coating lacquer | Scratch and edge <1 mm | Scratch <1 mm, edge 0 mm | Gt 0 |

*The standard aluminium alloy can weighed 10.4 g, and was 11.5 cm long and had a diameter of 6.5 cm.

The sliding angles were determined at room temperature using a laboratory apparatus constructed in-house and are given as the average value of several measurements. The sliding test on standard cans pretreated according to the invention with phosphonates showed a sliding angle of only ca. 28° after a temperature treatment at about 180° C. In comparison, the standard can that had been treated after the separate conversion coating with a standard lubricant based on ethoxylated compounds, on which no second conversion coating was formed, exhibited, after low temperature drying, a sliding angle of on average 21° to 22° C., whereas after a temperature treatment at about 180° C. exhibited a sliding angle of on average as high as ca. 32°. The cleaned cans (pre)treated according to the invention exhibit in particular sliding angles that are at least 5°, preferably at least 8° and particularly preferably at least 12° less than the sliding angles of similar cans that have only been cleaned.

In addition filiform tests were carried out in order to determine the creepage of the lacquer on a scratch after 3024 hours. Creepage values of in each case less than 1 mm were found in this connection.

The results on chromium-free phosphonate-pretreated metal sheeting coated with polyester powder lacquer corresponded as regards corrosion resistance and lacquer adhesion results to the results obtained on high-grade chromated metal sheeting of this aluminium alloy. However, the results of the ESS tests were in some cases somewhat better than the chromating results.

It is claimed:

1. A process comprising the step of applying to a container an agent comprising at least one compound of the formula XYZ, X*Y*Z* or X*Y*Z*Y*X*, wherein Y is an organic group with 2 to 50 C atoms, X and Z are identical or different and are selected from —OH, —SH, —$NH_2$, —NHR', —CN, —CH═$CH_2$, —OCN, —CONHOH, —COOR', acrylic acid amide, epoxy, $CH_2$═CR"COO—, —COOH, —$HSO_3$, —$HSO_4$, $(OH)_2PO$—, $(OH)_2PO_2$—, (OH)(OR')PO—, (OH)(OR')$PO_2$—, —$SiH_3$ or $Si(OH)_3$, wherein R' is an alkyl group with 1 to 4 C atoms, R" is an H atom or an alkyl group with 1 to 4 C atoms, and wherein X and Z are each bound to Y at its terminal position;

Y* is an organic group with 1 to 30 C atoms, X* and Z* are identical or different and are selected from —OH, —SH, —$NH_2$, —NHR', —CN, —CH═$CH_2$, —OCN, —CONHOH, COOR, acrylic acid amide, epoxy, —$CH_2$═CR"—COO—, —COOH, —$HSO_3$, —$HSO_4$, $OH)_2PO$—, $(OH)_2PO_2$—, (OH)(OR')PO—, (OH)(OR')$PO_2$—, —$SiH_3$, —$Si(OH)_3$, >N—$CH_2$—$PO(OH)_2$ or —N—[$CH_2$—$PO(OH)_2$]$_2$, wherein R' is an alkyl group with 1 to 4 C atoms, and R" is an H atom or an alkyl group with 1 to 4 C atoms, and wherein said container comprises a member selected from the group consisting of aluminum, an aluminum-containing alloy, a magnesium-containing alloy, an iron-containing material, a coated iron-containing material, a galvanized metallic material, a metallic material coated with at least one of aluminum and an aluminum alloy, tinplate, brass and bronze, wherein the application step is for the treatment or pretreatment of said container and the agent is applied to said container when the container is traveling at a rate of from 500 to 5000 containers per minute.

2. A process comprising the step of applying to a container comprising at least on metal selected from the group consisting of aluminum, a aluminum-containing alloy, a magnesium-containing alloy, steel, tinplate, an agent comprising at least one compound of the formula XYZ, X*Y*Z* or X*Y*Z*Y*X*, wherein Y is an organic group with 2 to 50 C atoms, X and Z are identical or different and are selected from —OH, —SH, —$NH_2$, —NHR', —CN, —CH═$CH_2$, —OCN, —CONHOH, —COOR', acrylic acid amide, epoxy, $CH_2$═CR"—COO—, —COOH, —$HSO_3$, —$HSO_4$, $(OH)_2PO$—, $(OH)_2PO_2$—, (OH)(OR')PO—, (OH)(OR') $PO_2$—, —$SiH_3$ or —$Si(OH)_3$, wherein R' is an alkyl group with 1 to 4 C atoms, R" is an H atom or an alkyl group with 1 to 4 C atoms and the groups X and Z are each bound to the group Y at its terminal position, Y* is an organic group with 1 to 30 C atoms;

X* and Z* are the same or different and denote an —OH, —SH, —$NH_2$, —NHR', —CN, —CH═$CH_2$, —OCN, —CONHOH, —COOR', acrylic acid amide, epoxy, $CH_2$═CR"—COO—, —COOH, —$HSO_3$, —$HSO_4$, $(OH)_2PO$—, $(OH)_2PO_2$—, (OH)(OR')PO, (OH)(OR') $PO_2$—, —$SiH_3$, —$Si(OH)_3$, >N—$CH_2$—$PO(OH)_2$ and an —N—[$CH_2$—$PO(OH)_2$]$_2$ group, wherein R" is an alkyl group with 1 to 4 C atoms, and R" is an H atom or an alkyl group with 1 to 4 C atoms, and wherein the agent is applied to said container when the container is traveling at a rate of from 500 to 5000 containers per minute.

3. A process according to claim 1, wherein a first or second conversion coating is produced on the metallic substrate with said agent used.

4. A process according to claim 2, wherein a first or second conversion coating is produced on the metallic substrate with said agent used.

5. A process according to claim 1, wherein a lubricant forms in said agent during the formation of the coating produced therefrom.

6. A process according to claim 2, wherein a lubricant forms in said agent during the formation of the coating produced therefrom.

7. A process according to claim 1, wherein said agent is an aqueous solution or an aqueous dispersion.

8. A process according to claim 2, wherein said agent is an aqueous solution or an aqueous dispersion.

9. A process according to claim 1, wherein said agent is free or largely free of fluoride.

10. A process according to claim 2, wherein said agent is free or largely free of fluoride.

11. A process according to claim 1, wherein said agent is free or largely free of phosphate calculated as $PO_4$.

12. A process according to claim 2, wherein said agent is free or largely free of phosphate calculated as $PO_4$.

13. A process according to claim 1, wherein the agent is free or largely free of chromium.

14. A process according to claim 1, wherein the agent is free or largely free of iron, manganese, nickel, cobalt, copper, other steel additives/improvers and zinc and is free or substantially free of heavy metals.

15. A process according to claim 1, wherein the agent is free or largely free of ethoxylated compounds, and is preferably free or largely free of surfactants.

16. A process according to claim 1, wherein silicon-containing alloys are treated or pretreated.

17. A process according to claim 1, wherein the agent for the treatment and pretreatment, which is optionally a lubricant, contains at least one compound XYZ, wherein X is a —COOH, —$HSO_3$, —$HSO_4$, $(OH)_2PO$—, $(OH)_2PO_2$—, (OH)(OR')PO— or (OH)(OR')$PO_2$— group, Y is an organic group R that contains 2 to 50 C atoms, of which at least 60% of these C atoms are present as $CH_2$ groups, Z is an —OH, —SH, —$NH_2$, —NHR', —CN, —CH═$CH_2$, —OCN, epoxy, $CH_2$═CR"—COOH, acrylic acid amide, —COOH, $(OH)_2PO$—, $(OH)_2PO_2$—, (OH)(OR')PO— or (OH)(OR')$PO$—$_2$ group, with R'being an alkyl group with 1 to 4 C atoms and R" being an H atom or an alkyl group with 1 to 4 C atoms.

18. A process according to claim 1, wherein the groups X* and Z* of the compound of the formula X*Y*Z* or X*Y*Z*Y*X* or in each case bonded to the group Y* in its terminal position.

19. A process according to claim 1, wherein the compound of the formula XYZ, X*Y*Z* or X*Y*Z*Y*X* is suitable for forming self-organizing molecules that can form a layer of the said self-organizing molecules on the metallic surface.

20. A process according to claim 1, wherein Y or Y* is a linear unbranched chain.

21. A process according to claim 2, wherein Y or Y* is a linear, unbranched.

22. A process according to claim 1, wherein the more effective compounds of the formula XYZ, X*Y*Z* or X*Y*Z*Y*X* have a group Y or Y* that has an even number of C atoms.

23. A process according to claim 1, wherein at least one compound of the formula XYZ, X*Y*Z* or X*Y*Z*Y*X* is present as a salt and acid in an aqueous solution.

24. A process according to claim 1, wherein the group Y or Y* of the more effective compounds of the formula XYZ, X*Y*Z* or X*Y*Z*Y*X* is an unbranched straight-chain alkyl group with 3 to 30 C atoms.

25. A process according to claim 1, wherein the agent for the treatment or pretreatment contains at least one compound of the formula XYZ, X*Y*Z* or X*Y*Z*Y*X* wherein Y or Y* is an unbranched alkyl group with 2 to 20 C atoms or an unbranched group consisting of 1 to 4 aromatic $C_5H_4$ nuclei bonded in the p-position, or is a group consisting of unbranched alkyl radicals with in each case 1 to 20 C atoms as well as 1 to 4 aromatic $C_6H_4$ nuclei bonded in the p-position.

26. A process according to claim 1, wherein the agent for the treatment or pretreatment contains at least one compound of the formula XYZ, X*Y*Z* or X*Y*Z*Y*X* in which Y or Y* is an unbranched alkyl group with 6 to 20 C atoms or is a p-$CH_2$—$C_4H_6$—$CH_2$ group or a p,p'-$C_6H_4$—$C_6H_4$ group.

27. A process according to claim 1, wherein the agent for the treatment or pretreatment contains at least one compound of the formula XYZ, X*Y*Z* or X*Y*Z*Y*X* in which X or X* is a an $(OH)_2PO_2$— or (OH)(OR')$PO_2$-group.

28. A process according to claim 1, wherein the agent for the treatment or pretreatment contains at least one compound of the formula XYZ, X*Y*Z* or X*Y*Z*Y*X*, in which Z or Z* is an $(OH)_2PO_2$—, (OH)(OR')$PO_2$—, —OH, —SH, —NHR', —CH═$CH_2$ or —$CH_2$═CR"—COOH group.

29. A process according to claim 1, wherein the agent for the treatment or pretreatment contains at least one of the following compounds of the formula XYZ, X*Y*Z* or X*Y*Z*Y*X*:

1-phosphonic acid-12-mercaptododecane,
1-phosphonic acid-12-(N-ethylamino) dodecane,
1-phosphonic acid-12-dodecene,
p-xylylene-diphosphonic acid,
1,10-decanediphosphonic acid,
1,12-dodecanediphosphonic acid,
1,14-tetradecanediphosphonic acid,
1-phosphoric acid-12-hydroxydodecane,
1-phosphoric acid-12-(N-ethylamino) dodecane,
1-phosphoric acid-12-dodecene,
1-phosphoric acid-12-mercaptododecane,
1,10-decanediphosphoric acid,
1,12-dodecanediphosphoric acid,
1,14-tetradecanediphosphoric acid,
p,p'-biphenyldiphosphoric acid,
1-phosphoric acid-12-acryloyldodecane,
1,8-octanediphosphonic acid,
1,6-hexanediphosphonic acid,
1,4-butanediphosphonic acid,
1,8-octanediphosphoric acid,
1,6-hexanediphosphoric acid,
1,4-butanediphosphoric acid,
aminotrimethylenephosphonic acid,
ethylenediaminetetramethylenephosphonic acid,
hexamethylenediaminetetramethylenephosphonic acid,
diethylenetriaminepentamethylenephosphonic acid, and 2-phosphonebutane-1,2,4-tricarboxylic acid, or a salt thereof or wherein X and Z are $(OH_2)PO_2$— and Y is a $C_{12}$-$C_{20}$ straight chain alkyl.

30. A process according to claim 1, wherein the agent for the treatment or pretreatment is contained together with at least one compound of the formula XYZ, X*Y*Z* or X*Y*Z*Y*X* in an aqueous solution with it being possible for 0.01 to 50% of water to be replaced by at least one organic solvent.

31. A process according to claim 1, wherein the agent for the treatment or pretreatment contains at least one compound of the formula XYZ, X*Y*Z* or X*Y*Z*Y*X* that is present in the region of the critical micelle concentration or therebelow.

32. A process according to claim 1, wherein the agent for the treatment or pretreatment contains at least one compound of the formula XYZ, X*Y*Z*, or X*Y*Z*Y*X* that is present as a salt in the solution.

33. A process according to claim 1, wherein the agent for the treatment or pretreatment comprises, only compounds of the formula XYZ, X*Y*Z* or X*Y*Z*Y*X* as compounds that produce a conversion layer and serve as lubricant.

34. A process according to claim 1, wherein the agent for the treatment or pretreatment is, as regards the compounds that form a conversion layer and serve as lubricant, contained in water or in a water-solvent mixture in an amount of 0.01 to 15 g/l.

35. A process according to claim 1, wherein the agent for the treatment or pretreatment comprises, in addition to water or a water-solvent mixture, at least one compound of the formula XYZ, X*Y*Z* or X*Y*Z*Y*X* at least silane as well as optionally a biocide, demulsifier, fragrance, emulsifier, defoaming agent, solubility promoter, surfactant, agent for adjusting the pH value, agent for adjusting the electrical conductivity and other auxiliary substances and optionally an amount of at least one organic solvent.

36. A process according to claim 1, wherein the agent for the treatment or pretreatment also contains a defoaming agent and a solubility promoter.

37. A process according to claim 1, wherein the agent for the treatment or pretreatment is applied internally and externally to the containers by dipping or rolling, preferably by sprinkling, spraying or atomization over a time in the range from 0.1 to 120 seconds per container.

38. A process according to claim 1, wherein optionally at least one rinsing is carried out after the application of the agent for the treatment or pretreatment, which at the same time is also a lubricant or contains a lubricant.

39. A process according to claim 1, wherein the agent for the treatment or pretreatment is applied to a cleaned, rinsed and pickled surface or to a pre-annealed surface.

40. A process according to claim 1, wherein before the application of the agent for the treatment or pretreatment, the surface of the container is cleaned to a neutral, acid or alkaline pH, is optionally rinsed, optionally pickled to an alkaline or acid pH and optionally rerinsed, in which connection water and an organic solvent may be used as solvent.

41. A process according to claim 1, wherein before the application of the agent for the treatment or pretreatment, another agent for the treatment or pretreatment is applied, wherein the agent contains ions selected from the group consisting of Ti, Zr, Hf, Cu, Fe, Mn, Ni, Zn, $PO_4$ and F.

42. A process according to claim 1, wherein after the application of the agent for the treatment or pretreatment, the surface of the container is optionally rinsed, optionally post-rinsed with a post-rinsing solution, optionally rerinsed and dried, in which connection water and an organic solvent may be used as solvent.

43. A process according to claim 1, wherein after the application of the agent for the treatment or pretreatment, rinsing is no longer performed.

44. A process according to claim 1, wherein at least one compound of the formula XYZ, X*Y*Z* or X*Y*Z*Y*X* is used to improve the corrosion resistance and lacquer adhesion.

45. A process according to claim 1, wherein the agent is applied in a conveyor belt unit, preferably by sprinkling.

46. A process according claim 1, wherein the agent is applied for a time ranging from 0.1 to 120 seconds.

47. A process according to claim 1, wherein the agent is applied to metallic surfaces of containers that have a temperature in the range from 10 to 100° C.

48. A process according to claim 1, wherein the agent during application to the containers has a temperature in the range from 10 to 90° C.

49. A process according to claim 1, wherein the coating formed by the agent has a thickness of one or a few molecular layers after drying.

50. A process according to claim 1, wherein the treated and pretreated containers are dried under mass production conditions at a temperature of at least 180° C.

51. A process according to claim 1, wherein the treated or pretreated containers are dried under mass production conditions at a temperature of at most 150° C.

52. A process according to claim 1, wherein different containers are treated.

53. A process according to claim 1, wherein the agent is free or largely free of chromium.

54. A process according to claim 2, wherein the agent is free or largely free of iron, manganese, nickel, cobalt, copper, other steel additives/improvers and zinc and is free or largely free of heavy metals.

55. A process according to claim 2, wherein the agent is free or largely free of ethoxylated compounds and is free or largely free of surfactants.

56. A process according to claim 2, wherein silicon-containing alloys are treated or pretreated.

57. A process according to claim 2, wherein the agent for the treatment and pretreatment, which is optionally a lubricant, contains at least one compound of the formula XYZ, wherein X is a —COOH, —$HSO_3$, —$HSO_4$, $(OH)_2PO$—, $(OH)_2PO_2$—, (OH)(OR')PO— or $(OH)(OR')PO_2$— group, Z is an —OH, —SH, —$NH_2$, —NHR', —CN, —CH═$CH_2$, —OCN, epoxy, $CH_2$═CR"—COOH, acrylic acid amide, —COOH, $(OH)_2PO$—, $(OH)_2PO_2$—, (OH)(OR')PO— or (OH)(OR')PO—$_2$ group, and Y is an organic group R that contains 2 to 50 C atoms, of which at least 60% of these C atoms are present as $CH_2$ groups, wherein R' is an alkyl group with 1 to 4 C atoms and R" being an H atom or an alkyl group with 1 to 4 C atoms.

58. A process according to claim 2, wherein the groups X* and Z* of the compound of the formula X*Y*Z* or X*Y*Z*Y*X* or in each case bonded to the group Y* in its terminal position.

59. A process according to claim 2, wherein the compound of the formula XYZ, X*Y*Z* or X*Y*Z*Y*X* is suitable for forming self-organizing molecules that can form a layer of the said self-organizing molecules on the metallic surface.

60. A process according to claim 2, wherein Y or Y* is a linear unbranched chain.

61. A process according to claim 2, wherein Y or Y* is a linear, unbranched or branched chain with at least one functional group.

62. A process according to claim 2, wherein the more effective compounds of the formula XYZ, X*Y*Z* or X*Y*Z*Y*X* have a group Y or Y* that has an even number of C atoms.

63. A process according to claim 2, wherein at least one compound of the formula XYZ, X*Y*Z* or X*Y*Z*Y*X* is present as a salt and acid in an aqueous solution.

64. A process according to claim 2, wherein the group Y or Y* of the more effective compounds of the formula XYZ, X*Y*Z* or X*Y*Z*Y*X* is an unbranched straight-chain alkyl group with 3 to 30 C atoms.

65. A process according to claim 2, wherein the agent for the treatment or pretreatment contains at least one compound of the formula XYZ, X*Y*Z* or X*Y*Z*Y*X* wherein Y or Y* is an unbranched alkyl group with 2 to 20 C atoms or an unbranched group consisting of 1 to 4 aromatic $C_5H_4$ nuclei bonded in the p-position, or is a group consisting of unbranched alkyl radicals with in each case 1 to 20 C atoms as well as 1 to 4 aromatic $C_6H_4$ nuclei bonded in the p-position.

66. A process according to claim 2, wherein the agent for the treatment or pretreatment contains at least one compound of the formula XYZ, X*Y*Z* or X*Y*Z*Y*X* in which Y or Y* is an unbranched alkyl group with 6 to 20 C atoms or preferably 10 to 18 C atoms or is a p-$CH_2$—$C_4H_6$—$CH_2$ group or a p,p'-$C_6H_4$—$C_6H_4$ group.

67. A process according to claim 2, wherein the agent for the treatment or pretreatment contains at least one compound of the formula XYZ, X*Y*Z* or X*Y*Z*Y*X* in which X or X* is a an $(OH)_2PO_2$— or $(OH)(OR')PO_2$-group.

68. A process according to claim 2, wherein the agent for the treatment or pretreatment contains at least one compound of the formula XYZ, X*Y*Z* or X*Y*Z*Y*X*, in which Z or Z* is an $(OH)_2PO_2$—, $(OH)(OR')PO_2$—, —OH, —SH, —NHR', —CH═$CH_2$ or —$CH_2$═CR"—COOH group.

69. A process according to claim 2, wherein the agent for the treatment or pretreatment contains at least one of the following compounds of the formula XYZ, X*Y*Z* or X*Y*Z*Y*X*:

1-phosphonic acid-12-mercaptododecane,
1-phosphonic acid-12-(N-ethylamino) dodecane,
1-phosphonic acid-12-dodecene,
p-xylylene-diphosphonic acid,
1,10-decanediphosphonic acid,
1,12-dodecanediphosphonic acid,
1,14-tetradecanediphosphonic acid,
1-phosphoric acid-12-hydroxydodecane,
1-phosphoric acid-12-(N-ethylamino) dodecane,
1-phosphoric acid-12-dodecene,
1-phosphoric acid-12-mercaptododecane,
1,10-decanediphosphoric acid,
1,12-dodecanediphosphoric acid,
1,14-tetradecanediphosphoric acid,
p,p'-biphenyldiphosphoric acid,
1-phosphoric acid-12-acryloyldodecane,
1,8-octanediphosphonic acid,
1,6-hexanediphosphonic acid,
1,4-butanediphosphonic acid,
1,8-octanediphosphoric acid,
1,6-hexanediphosphoric acid,
1,4-butanediphosphoric acid,
aminotrimethylenephosphonic acid,
ethylenediaminetetramethylenephosphonic acid,
hexamethylenediaminetetramethylenephosphonic acid,
diethylenetriaminepentamethylenephosphonic acid, and
2-phosphonebutane-1,2,4-tricarboxylic acid, or a salt thereof or wherein X and Z are $(OH)_2PO_2$— and Y is a $C_{12}$-$C_{20}$ straight chain alkyl.

70. A process according to claim 2, wherein the agent for the treatment or pretreatment is contained together with at least one compound of the formula XYZ, X*Y*Z* or X*Y*Z*Y*X* in an aqueous solution with it being possible for 0.01 to 50% of the water to be replaced by at least one organic solvent such as for example an alcohol with 1 to 8 C atoms, by acetone, by dioxane and by tetrahydrofuran.

71. A process according to claim 2, wherein the agent for the treatment or pretreatment contains at least one compound of the formula XYZ, X*Y*Z* or X*Y*Z*Y*X* that is present in the region of the critical micelle concentration or therebelow.

72. A process according to claim 2, wherein the agent for the treatment or pretreatment contains at least one compound of the formula XYZ, X*Y*Z*, or X*Y*Z*Y*X* that is present as a salt in the solution.

73. A process according to claim 2, wherein the agent for the treatment or pretreatment comprises, only compounds of the formula XYZ, X*Y*Z* or X*Y*Z*Y*X* as compounds that produce a conversion layer and serve as lubricant.

74. A process according to claim 2, wherein the agent for the treatment or pretreatment is, as regards the compounds that form a conversion layer and serve as lubricant, contained in water or in a water-solvent mixture in an amount of 0.01 to 15 g/l.

75. A process according to claim 2, wherein the agent for the treatment or pretreatment comprises, in addition to water or a water-solvent mixture, at least one compound of the formula XYZ, X*Y*Z* or X*Y*Z*Y*X* at least silane as well as optionally a biocide, demulsifier, fragrance, emulsifier, defoaming agent, solubility promoter, surfactant, agent for adjusting the pH value, agent for adjusting the electrical conductivity and other auxiliary substances and optionally an amount of at least one organic solvent.

76. A process according to claim 2, wherein the agent for the treatment or pretreatment also contains a defoaming agent and a solubility promoter.

77. A process according to claim 2, wherein the agent for the treatment or pretreatment is applied internally and externally to the containers by dipping or rolling, preferably by sprinkling, spraying or atomization over a time in the range from 0.1 to 120 seconds per container.

78. A process according to claim 2, wherein optionally at least one rinsing is carried out after the application of the agent for the treatment or pretreatment, which at the same time is also a lubricant or contains a lubricant.

79. A process according to claim 2, wherein the agent for the treatment or pretreatment is applied to a cleaned, rinsed and pickled surface or to a pre-annealed surface.

80. A process according to claim 2, wherein before the application of the agent for the treatment or pre-treatment, the surface of the container is cleaned to a neutral, acid or alkaline pH, is optionally rinsed, optionally pickled to an alkaline or acid pH and optionally rerinsed, in which connection water and an organic solvent may be used as solvent.

81. A process according to claim 2, wherein before the application of the agent for the treatment or pretreatment, another agent for the treatment or pretreatment is applied, wherein the agent contains ions from the group of Ti, Zr, Hf, Cu, Fe, Mn, Ni, Zn, $PO_4$ and F.

82. A process according to claim 2, wherein after the application of the agent for the treatment or pretreatment, the surface of the container is optionally rinsed, optionally post-rinsed with a post-rinsing solution, optionally rerinsed and dried, in which connection water and an organic solvent may be used as solvent.

83. A process according to claim 2, wherein after the application of the agent for the treatment or pretreatment, rinsing is no longer performed.

84. A process according to claim 2, wherein at least one compound of the formula XYZ, X*Y*Z* or X*Y*Z*Y*X* is used to improve the corrosion resistance and lacquer adhesion.

85. A process according to claim 2, wherein the agent is applied in a conveyor belt unit, preferably by sprinkling.

86. A process according to claim 1, wherein the agent is applied for a time ranging from 0.1 to 120 seconds.

87. A process according to claim 2, wherein the agent is applied to metallic surfaces of containers that have a temperature in the range from 10 to 100° C.

88. A process according to claim 2, wherein the agent during application to the containers has a temperature in the range from 10 to 90° C.

89. A process according to claim 2, wherein the coating formed by the agent has a thickness of one or a few molecular layers after drying.

90. A process according to claim 2, wherein the treated and pretreated containers are dried under mass production conditions at a temperature of at least 180° C.

91. A process according to claim 2, wherein the treated or pretreated containers are dried under mass production conditions at a temperature of at most 150° C.

92. A process according to claim 2, wherein different containers are treated.

* * * * *